US006883665B1

(12) United States Patent
Ahn

(10) Patent No.: US 6,883,665 B1
(45) Date of Patent: Apr. 26, 2005

(54) VACUUM PACKING BAG

(75) Inventor: Joung Geun Ahn, Ansan-si (KR)

(73) Assignee: Zeropack Co., Ltd., Ansan (KR)

( * ) Notice: Subject to any disclaimer, the term of this patent is extended or adjusted under 35 U.S.C. 154(b) by 0 days.

(21) Appl. No.: 10/203,642

(22) PCT Filed: Apr. 1, 2000

(86) PCT No.: PCT/KR00/00297

§ 371 (c)(1),
(2), (4) Date: Oct. 7, 2002

(87) PCT Pub. No.: WO01/62602

PCT Pub. Date: Aug. 30, 2001

(30) Foreign Application Priority Data

Feb. 25, 2000 (KR) ..... 2000-9530

(51) Int. Cl.[7] ..... B65D 81/20
(52) U.S. Cl. ..... 206/524.8
(58) Field of Search ..... 206/524.8, 484; 353/109–119; 429/35.2, 35.3, 35.7

(56) References Cited

U.S. PATENT DOCUMENTS 3,484,835 A * 12/1969 Trounstine et al. ..... 428/179
3,760,940 A 9/1973 Bustin
3,911,187 A * 10/1975 Raley ..... 428/180
3,973,063 A * 8/1976 Clayton ..... 428/35.2
4,316,070 A * 2/1982 Prosise et al. ..... 219/728
4,343,848 A * 8/1982 Leonard, Jr. ..... 428/156
4,518,643 A * 5/1985 Francis ..... 428/131
5,103,979 A * 4/1992 Hustad ..... 206/459.1
5,346,312 A * 9/1994 Mabry et al. ..... 383/113
5,447,772 A * 9/1995 Flieger ..... 428/99
5,618,111 A * 4/1997 Porchia et al. ..... 383/63
5,790,718 A * 8/1998 Tenner et al. ..... 383/127
6,371,643 B1 * 4/2002 Saad et al. ..... 383/63
6,550,966 B1 * 4/2003 Saad et al. ..... 383/103

* cited by examiner

*Primary Examiner*—Shian T. Luong
(74) *Attorney, Agent, or Firm*—Greenblum & Bernstein, P.L.C.

(57) ABSTRACT

A vacuum bag includes a tubular, flat main body and one or more embossed interposition sheets. The main body has upper and lower portions. The embossed interposition sheets are bonded at both side ends of the main body while being interposed between the upper and lower portions. The one side end of each embossed interposition sheet is bonded region of the upper and lower portions when each embossed interposition sheet is interposed between the upper and lower portions. The embossed interposition sheet may be approximately half or less of the width of the main body.

5 Claims, 4 Drawing Sheets

VACUUM PACKING BAG

BACKGROUND OF THE INVENTION

1. Field of the Invention

The present invention relates, in general, to vacuum packing bags applied to a vacuum packing apparatus and, more particularly, to a vacuum packing bag that is provided with an interposition sheet with predetermined embossed patterns formed thereon that is attached on the upper and lower packing portions, respectively, whereby it reduces the period of time required for the vacuum process therein when compared with existing vacuum packing bags and the vacuum state therein is reliably maintained for a substantially long period of time.

2. Description of the Prior Art

Generally, a vacuum packing technique is an art in which food is contained in a bag and the bag is vacuumized and sealed so as to store the food for a long period of time by preventing the oxidation of the food. Although there may be used a technique in which food is stored in a refrigerator at a low temperature, the technique in which food is vacuum-packed so as to avoid the contact of the food with air is more effective for storing the food for a long period of time.

FIG. 1 is a perspective view showing a conventional vacuum packing apparatus and a vacuum packing bag applied to the apparatus. FIG. 2 is cross section taken along line A—A of FIG. 1.

As illustrated in FIGS. 1 and 2, the conventional vacuum packing apparatus comprises a base 10, a press cover 20, lower and upper rubber press members 23 and 24 respectively fixed to the base 10 and the press cover 20, a vacuum pump 25 for vacuumizing the vacuum packing bag 30 after the vacuum packing bag 30 is inserted into the space between the base 10 and the press cover 20, a heater 21 positioned in the base 10 to seal the packing bag 30 by means of heat, and a heater pressing member 22.

In accordance with the conventional vacuum packing apparatus, the below operation is performed. The vacuum packing bag 30 containing food is positioned on the lower rubber press member 23 at its open end. The press cover 20 is rotated downwardly so that the upper rubber press member 23 comes into contact with the lower rubber press member 24. At this state, the vacuum pump 25 is operated, so a space formed by the lower and upper rubber press member 23 and 24 is vacuumized. At this time, if a typical vinyl bag is used, the air in the bag can not be discharged easily. However, since the vacuum packing bag 30 shown in FIGS. 1 and 2 is entirely embossed on its upper portion, the air in the bag 30 may be easily discharged. After the bag 30 is vacuumized, the heater 21 is activated, so that the bag 30 is sealed at its open end by means of heat generated by the heater 21.

However, according to the conventional vacuum packing bag, its manufacturing cost is high-priced due to embossments over an entire upper portion, vacuumization is impossible in a case where the embossed portion is ruptured, and powder contents are discharged though the embossments formed on the bag 30 when the contents in the bag are powder.

In addition, since embossments are entirely formed on the upper portion of the bag, the thickness of the bag is enlarged, thereby causing inconvenience to a user. Since the embossed portion is manufactured by means of engaged rollers at high temperature, the embossed portion is easily damaged in the process of manufacture.

Furthermore, since the embossments are formed on the entire upper portion, there is inconvenience in which trademark or design should be printed on a flat lower portion prior to the completion of the bag.

SUMMARY OF THE INVENTION

Accordingly, the present invention has been made keeping in mind the above problems occurring in the prior art, and an object of the present invention is to provide a vacuum packing bag, capable of reducing manufacturing cost and preventing failure in vacuumization.

Another object of the present invention is to provide a vacuum packing bag, capable of preventing the discharge of powder contents, reducing its thickness, allowing a user to see its contents and easily printing a trademark or design on the bag.

In order to accomplish the above object, the present invention provides a vacuum packing bag comprising a tubular, flat main body and one or more embossed interposition sheets, the main body consisting of upper and lower portions, and the one side end of the embossed interposition sheet being bonded along the bonded region of said upper and lower portions when said embossed interposition sheet being interposed between the upper and lower portions.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
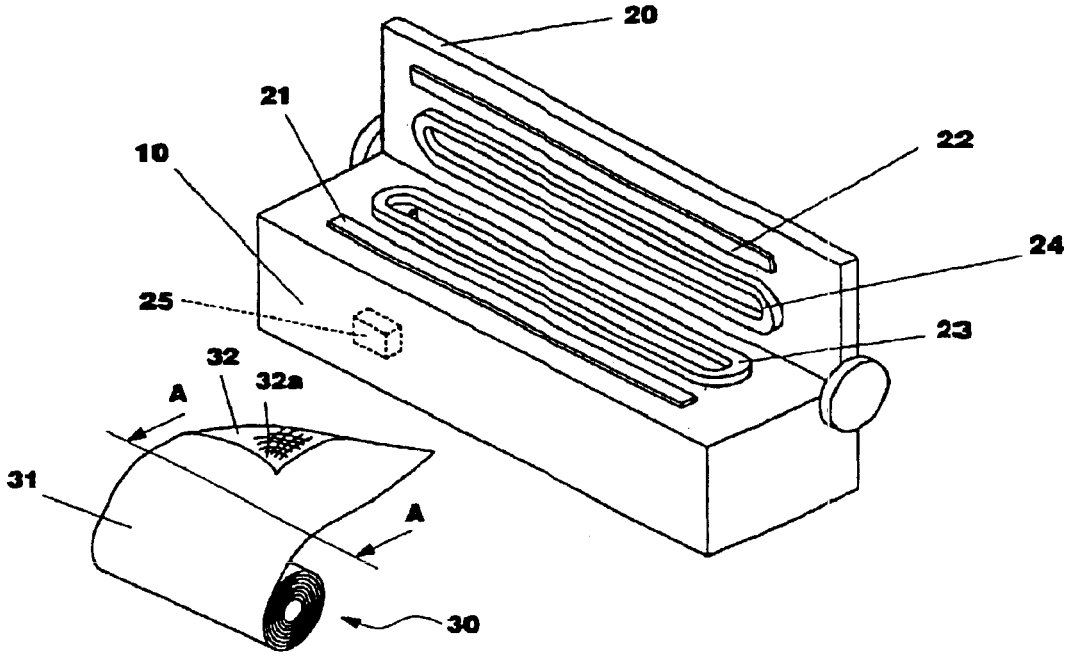
FIG. 1 is a perspective view showing a conventional vacuum packing apparatus and a vacuum packing bag applied to the apparatus.
Figure 2:
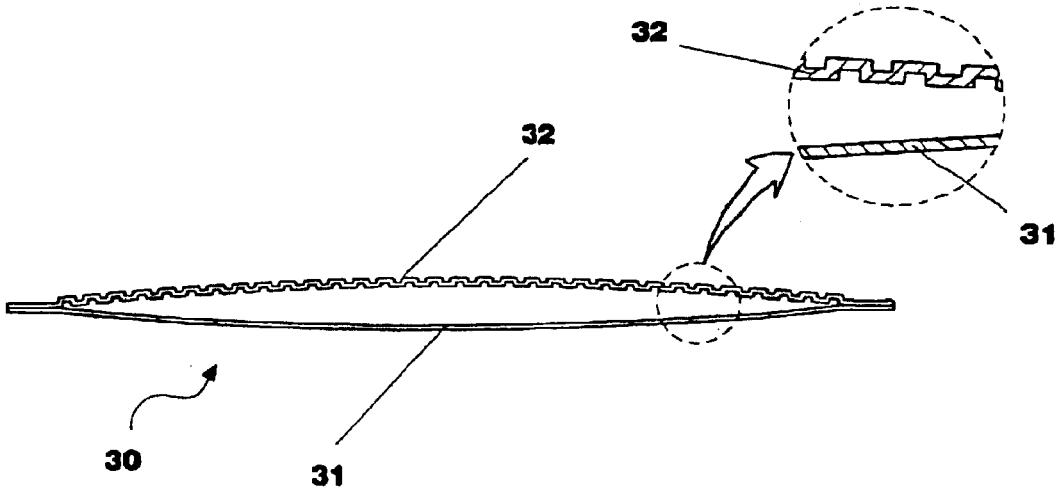
FIG. 2 is a cross section taken along line A—A of FIG. 1.
Figure 3:
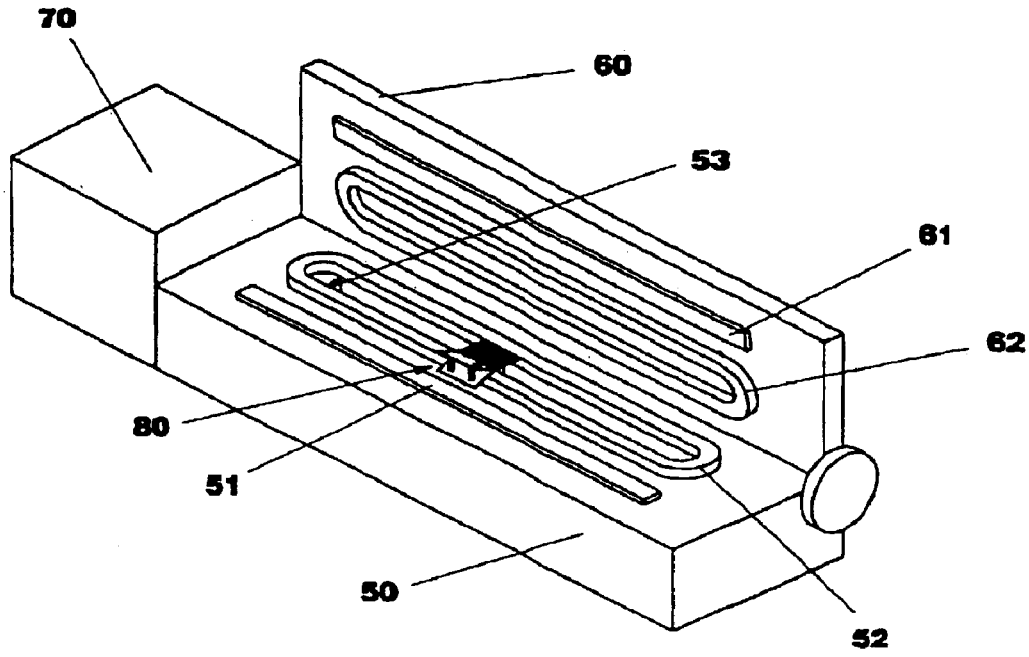
FIG. 3 is a perspective view showing a vacuum packing apparatus to which a vacuum packing bag according to a preferred embodiment of the present invention may be applied.
Figure 4:
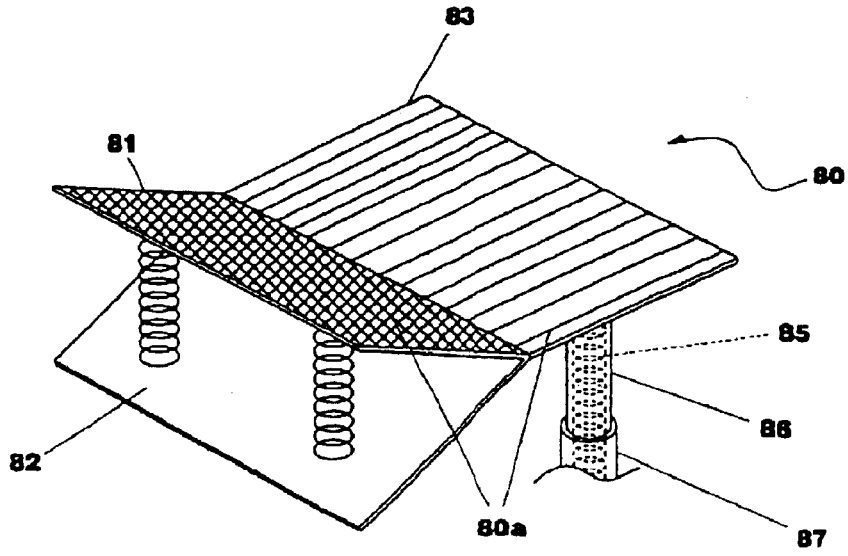
FIG. 4 is an enlarged perspective view showing an expander shown in FIG. 3.
Figure 5:
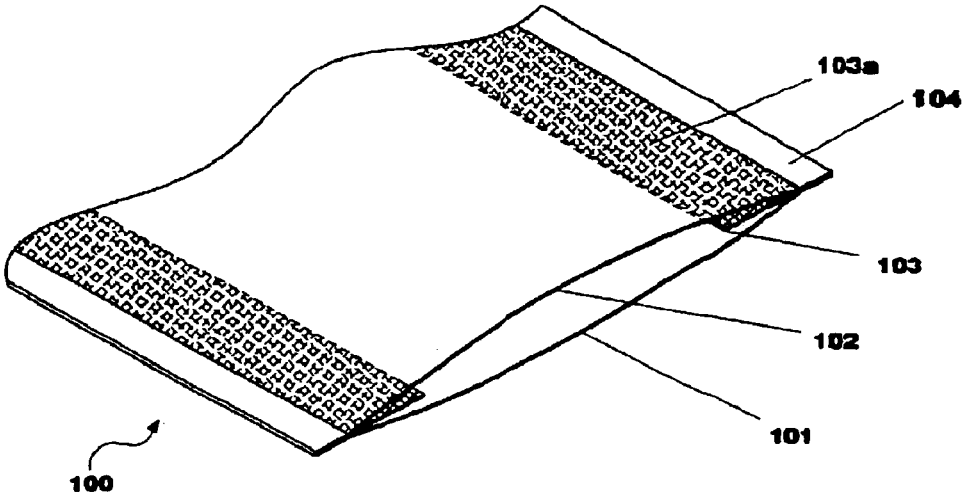
FIG. 5 is a perspective view showing the vacuum packing bag of the present invention.
Figure 6:
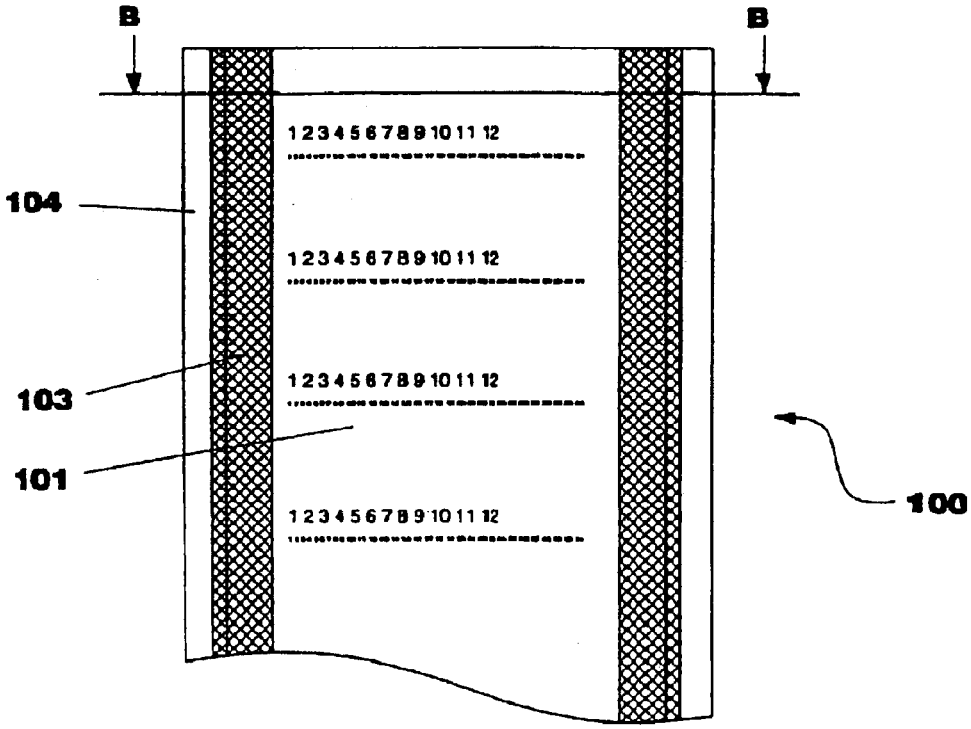
FIG. 6 is a plan view showing the vacuum packing bag of the present invention.
Figure 7:
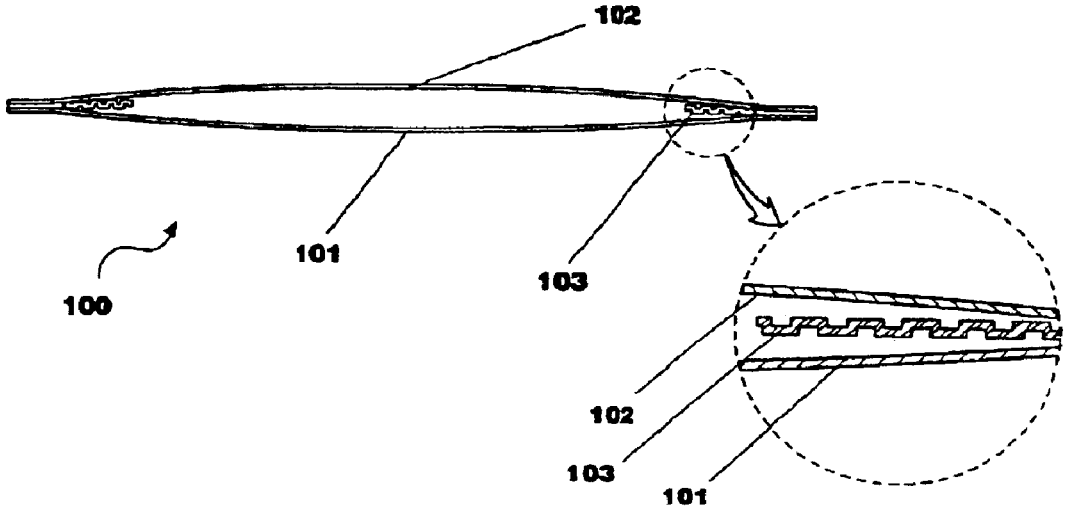
FIG. 7 is a cross section taken along line B—B of FIG. 6.

FIG. 3 is a perspective view showing a vacuum packing apparatus to which a vacuum packing bag according to a preferred embodiment of the present invention may be applied. FIG. 4 is an enlarged perspective view showing an expander shown in FIG. 3. FIG. 5 is a perspective view showing the vacuum packing bag of the present invention. FIG. 6 is a plan view showing the vacuum packing bag of the present invention. FIG. 7 is a cross section taken along line B—B of FIG. 6.

As illustrated in FIGS. 5 to 7, the vacuum packing bag 100 comprises a tubular, flat main body and two embossed interposition sheets 103, the tubular, flat main body consists of upper and lower portions 101 and 102. Each of the embossed interposition sheets 103 has embossments 103*a*. The upper and lower portions 101 and 102 are together bonded at their side ends, a so-called bonded region 104.

When each of the embossed interposition sheets 103 is interposed between the upper and lower portions 101 and 102, the one side end of said embossed interposition sheet is bonded along said bonded region 104.

In such a case, each of the embossed interposition sheets 103 is preferably made of material that may be easily bonded to the upper and lower portions 101 and 102, such as polyethylene(PE), high density polyethylene(HDPE) or polypropylene. Therefore, the embossed interposition sheet 103 is bonded to the upper and lower portions 101 and 102 effectively.

The width of each of the embossed interposition sheets 103 is preferably a half of the width of the flat main body or less.

On one surface of the main body is printed at regular intervals the calendar to indicate the date on which food is packed. That is to say, in one surface of the main body is printed the numeral of 1 to 12 to indicate a month and the numeral of 1 to 31 to indicate a date.

As shown in FIGS. 3 and 4, the vacuum packing apparatus to which the vacuum packing bag is applied comprises an electric device box 70 containing various electric devices, a base 50 connected to the electric device box 70, a press cover 60 rotatably connected to the base 50, a vacuum pump (not shown) positioned in electric device box 70, a lower rubber press member 52 on which an end of the vacuum packing bag is positioned, an upper rubber press member 62 that may come into contact with the lower rubber press member 52, a heater positioned in front of the lower rubber press member 52 so as to heat portions to be sealed, of the bag 100, a heater pressing member 61 positioned in front of the upper rubber press member 62, means (not shown) for moving the heater pressing member 61, and the expander 80 that may be interposed between the lower and upper rubber press members 52 and 62.

In such a case, as shown in FIG. 4, the expander 80 is a Y-shaped generally. The expander 80 comprises upper and lower insertion plates 81 and 82, an insertion spring 84, a support plate 83, a support spring 85, and upper and lower pipes 86 and 87. The upper and lower insertion plates 81 and 82 are spaced apart from each other at their first ends and are foldably connected to each other at their second ends. The insertion spring 84 is interposed between the upper and lower insertion plates 81 and 82. The support plate 83 is horizontally connected to the second ends of the upper and lower insertion plates 81 and 82 at its one end, and has embossments 80*a* at their outer surfaces. The support spring 85 elastically supports the support plate 83. The upper pipe 86 is fixed to the support plate 83 while surrounding the upper and middle portions of the support spring 85. The lower pipe 87 is slidably fitted around the lower end portion of the upper pipe 86 at its upper end portion and is fixed to the base 50 at its lower end while surrounding the lower portion of the support spring 85.

Although the heater 51 is positioned in front of the lower rubber press member 52 in the drawings, the heater 51 may be positioned behind the lower rubber press member 52.

In accordance with the embodiment, the below operation is performed. The Upper and lower insertion plates 81 and 82 of the expander 80 are inserted into one open end of the vacuum packing bag 100 containing food. Thereafter, the press cover 60 is rotated downwardly to the base 50, so that the upper rubber press member 52 comes into contact with the lower rubber press member 62. At this state, the vacuum pump is operated. When the vacuum pump is operated, the heater pressing member 61 is upwardly moved a certain distance by means of pressing member moving means, and at the same time a space sealed by the lower and upper rubber press members 23 and 24 is vacuumized. At this time, although the upper and lower insertion plates 81 and 82 of the expander 80 are widened by the insertion spring 84, the angle formed by the upper and lower insertion plates 81 and 82 is reduced as the air is discharged. Furthermore, the expander 80 has the embossments 80*a*. Therefore, since gaps exist as before though the lower and upper rubber press member 52 and 62 press the vacuum packing bag 100, the air is easily discharged. In addition, when the vacuum packing bag 100 of the present invention is used, the air in the vacuum packing bag 100 is easily discharged because the embossed interposition sheets 103 are interposed between the lower and upper rubber press members 52 and 62. When the pressure in the vacuum packing bag reaches a certain value, the heater pressing member 61 is lowered by means of the pressing member moving means. At this state, the heater 51 is activated, thereby sealing the vacuum packing bag.

In regard of a completed vacuum packing bag, a user may see the contents of the bag 100 because the flat main body is not embossed.

As described above, the present invention provides a vacuum packing bag, capable of reducing manufacturing cost and preventing failure in vacuumization by employing embossed interposition sheets.

In addition, the present invention provides a vacuum packing bag, capable of preventing the discharge of powder contents, reducing its thickness, allowing a user to see its contents and easily printing a trademark or design on the bag by employing flat main body.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vacuum packing bag, comprising:

a tubular, flat main body, said main body having upper and lower portions; and at least one embossed interposition sheet, a side end of a said at least one said embossed interposition sheet being bonded along a bonded region of said upper and lower portions when each said at least one embossed interposition sheet is interposed between said upper and lower portions;

wherein each said at least one embossed interposition sheet is approximately half or less of said main body in width.

2. The bag according to claim 1, wherein each said at least one embossed interposition sheet is made of material that is easily bonded to said main body.

3. The bag according to claim 2, wherein said each said at least one embossed interposition sheet is made of at least one of polyethylene, high density polyethylene and polypropylene.

4. The bag according to claim 1, further comprising a calendar date on a surface of said main body.

5. The bag according to claim 4, wherein said calendar date indicates a date on which contents of the bag are packed therein.

* * * * *

UNITED STATES PATENT AND TRADEMARK OFFICE

CERTIFICATE OF CORRECTION

PATENT NO. : 6,883,665 B1
DATED : April 26, 2005
INVENTOR(S) : J. G. Ahn et al.

It is certified that error appears in the above-identified patent and that said Letters Patent is hereby corrected as shown below:

Title page,
Item [57], ABSTRACT,
Line 2, after "vacuum" insert -- packing --.
Line 7, after "bonded" insert -- along a bonded --.

Signed and Sealed this

Thirteenth Day of December, 2005

JON W. DUDAS
*Director of the United States Patent and Trademark Office*